United States Patent [19]

Densen

[11] Patent Number: 4,463,997

[45] Date of Patent: Aug. 7, 1984

[54] KNOCKDOWN STORAGE UNIT

[76] Inventor: Mark S. Densen, 18 Blackburn Pl., Summit, N.J. 07901

[21] Appl. No.: 385,530

[22] Filed: Jun. 7, 1982

[51] Int. Cl.[3] ..... A47B 43/02

[52] U.S. Cl. ..... 312/259; 229/23 R; 312/257 R

[58] Field of Search ..... 312/260, 261, 259, 257 R; 211/194; 5/DIG. 1; 206/196, 154; 229/23 R, 23 AB, 40

[56] References Cited

U.S. PATENT DOCUMENTS

| | | | |
|---|---|---|---|
| 2,007,697 | 7/1935 | Usher | 229/23 R |
| 2,042,796 | 6/1936 | Murray | 229/23 R |
| 3,128,034 | 4/1964 | Weiss | 206/154 |
| 3,223,308 | 12/1965 | Weiss | 206/154 |
| 3,861,579 | 1/1975 | Manis et al. | 229/23 R |
| 4,080,023 | 3/1978 | Bair | 312/259 |
| 4,093,116 | 6/1978 | Watkins et al. | 229/40 |
| 4,261,627 | 4/1981 | Felsenthal | 312/259 |
| 4,282,999 | 8/1981 | Moen | 229/23 R |

FOREIGN PATENT DOCUMENTS

| | | | |
|---|---|---|---|
| 230390 | 3/1944 | Switzerland | 229/23 |

*Primary Examiner*—Victor N. Sakran
*Assistant Examiner*—Thomas A. Rendos
*Attorney, Agent, or Firm*—Arthur T. Fattibene

[57] ABSTRACT

A knockdown storage unit, such as a chest of drawers, a partitioned container or knockdown furniture piece for home and office storage comprising a body formed of one or more blanks, cut and scored so each blank can be readily folded and connected into an erected storage unit body wherein each blank is provided with complimentary interlocking tabs which are integrally formed along the opposed marginal edge portion of the respective blanks. The complimentary interlocking tabs include a T-shaped tab blanked out of a marginal flap hingedly connected along a marginal portion of the blank and a slotted tab connected to the opposite edge of the blank. The arrangement is such that the respective blank is folded and interconnected by interlocking the T-shaped tab with the complimentary slotted tab in the erected position whereby the respective tabs are positively interlocked. Suitable partitions and/or drawers are supported by the side walls of the erected body for storing various articles. The partitions are formed of blank sheet material, which is reversely folded, to define a doubled wall partition in a manner whereby the partition is supported between the opposed wall portions of the erected body. The partitions may extend transversely and/or longitudinally within the erected body to partition the body into a plurality of individual compartments. In an alternate arrangement, a drawer component may be slidably supported on the partition to define a chest of drawers.

13 Claims, 13 Drawing Figures

KNOCKDOWN STORAGE UNIT

STATE OF THE KNOWN ART

Various types of knockdown storage units are known. Generally, such knockdown storage units are formed of a single blank of sheet material that can be folded between an erected and knockdown position. The opposed edges of the blank defining the body are sealed together by gluing and/or bonding. Thus, the gluing of the opposed edges of the blanks to define a body portion requires a distinct manufacturing operation which increases the unit cost of the assembled body. Also, such containers, even in their collapsed state, may occupy considerable area. Because of its collapsed size, the package containing such glued, knockdown assembled units was relatively large, cumbersome and difficult to display and merchandize.

OBJECTS

An object of this invention is to provide an improved knockdown type of storage unit or simulated furniture piece which will occupy considerably less space in the knockdown position than that of a comparable unit of known glued construction.

Another object is to provide an improved knockdown type of storage unit or simulated furniture piece wherein the main body is formed of one or more readily foldable blanks which can be easily and positively secured by means of complimentary interlocking tabs.

Another object is to provide a knockdown type of storage unit or simulated furniture piece, the main body of which is formed of one or two components prescored and die cut blanks which are serially connected by complimentary interlocking tabs.

Another object is to provide for a knockdown type storage unit having a body formed of connected component parts without the need of any extraneous fasteners and which, in the erected position, can be utilized for a variety of different storage applications.

BRIEF SUMMARY OF THE INVENTION

The foregoing objects and other features and advantages are attained by an improved knockdown type storage unit simulating a furniture piece of a construction which comprises a main body portion which is formed of a single blank or of two generally similarly scored and die cut cardboard blanks arranged so that the respective blank or blanks can be positively secured together to form a generally rectangular open sided body. The respective blanks are each formed with complimentary interlocking tabs located on their respective opposing edge portions, whereby the edge or adjacent edges of the blank or blanks can be interloced with a corresponding edge of the one or other blank so that in the assembled position the respective blank or blanks are positively secure without the need of any extraneous fasteners. The opposed wall portion of the body thus defined also has hingedly connected to a marginal edge thereof a plurality of spaced flaps adapted to be reversely folded to the inside of the erected body so as to reinforce the wall portions. The flaps also provide a means for support between the opposed walls of the erected body a partition member or shelf. In accordance with this invention, the partitions are utilized to partition the interior of the erected box into a plurality of storage compartments or to provide a support for slidably receiving a drawer.

FEATURES

A feature of this invention resides in a storage unit construction of one or two generally similar blanks of sheet material which are each scored and die-cut to define a body portion of a knockdown storage unit.

Another feature resides in the provision wherein the opposed marginal edge portions of the respective blanks include complimentary interlocking tabs which, when interengaged, maintain the blank or blanks in an erected body forming position.

Another feature resides in a storage unit formed of two blanks which when erected, defines a main body having rectilinear opposed walls and a back wall to define a full open end body where each of the respective side and end walls have a double wall thickness, and wherein the inner wall portion defines the support for a shelf or partition within the erected body.

Another feature resides in an improved storage unit which has a main body portion which can be readily assembled without gluing, thereby simplifying the manufacturing operation and reducing the costs of production.

Other features and advantages will become more readily apparent when considered in view of the drawings and specification in which FIG. 1 is an exploded plan view of the blanks from which the knockdown storage body of this invention is formed.

DETAILED SPECIFICATION

Figures 1, 2, 3, 4, 5, 7, 8:
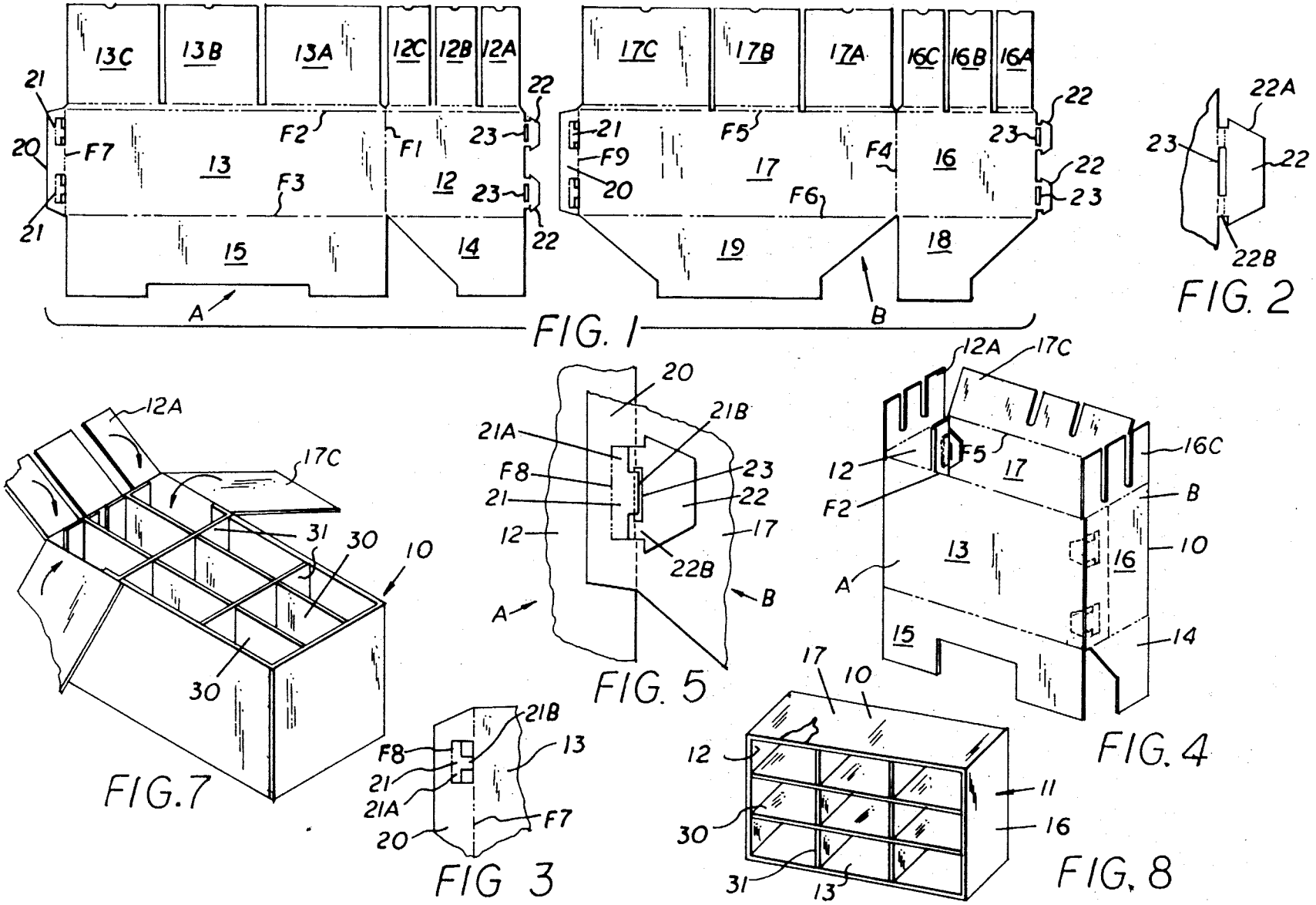
FIG. 2 is an enlarged detail view of a locking tab on one edge of the blank.
FIG. 3 is an enlarged detail view of the complimentary locking tab on the other edge of the blank.
FIG. 4 is a perspective view illustrating the two sections or blanks in an intermediate erected position.
FIG. 5 is a detailed view of the interlocking connection between the assembled blanks.
FIG. 7 is a perspective view of the storage unit illustrating the final steps of erection.
FIG. 8 is a perspective view of the completed, erected storage unit.

Referring to the drawings, there is shown in FIG. 1 the plan view of a pair of scored and die-cut blanks A and B from which the body 10 is formed to define a compartmentized storage unit 11 as will be hereinafter described. Each of the respective blanks A and B from which the body 10 is formed are generally similar in shape but for the back flaps as hereinafter noted. Blanks A and B are preferably formed of flat sheet material, as for example, cardboard, corrogated board and/or the like.

As is best seen in FIG. 1, blank A comprises a blank which is cut and scored to define an end forming wall portion 12 which is hingedly connected to a side forming wall portion 13 about a transversely extending foldline F1 as shown. The end wall portion 12 and side wall portion 13 extend longitudinally of the blank along the central portion thereof and are defined longitudinally by opposed foldlines F2 and F3. Hingedly connected to the side wall 13 along longitudinal foldline F2 are a plurality of side wall flaps 13A, 13B and 13C. Hingedly connected along the foldline F2 extending along the edge of the adjacent end wall 12 are plurality of end wall flaps 12A, 12B and 12C. Connected along the other foldline F3 extending longitudinally of the other side of the end wall 12 is an end forming black flap 14. The other longitudinal marginal portion of the side wall 13 has hingedly connected thereto along foldline F3, a side back forming flap 15.

Blank B, which defines the other half portion of the body 10 is likewise scored and die cut to define an end forming wall portion 16 whch is hingedly connected to a side forming wall portion 17 about a transversely extending foldline F4. Foldlines F5 and F6 extending longitudinally of the blank B define the longitudinal edges of the side wall 17 and the adjacent end wall 16. Hingedly folded about the foldline F5, which extends along one edge portion of the end wall 16, are plurality of end wall flaps 16A, 16B and 16C. An end forming back flap 18 is hingedly connected to the other edge portion of the end wall 16 along foldline F6.

The side wall portion 17 has hingedly connected to it along foldline F5 a plurality of sidewall flaps 17A, 17B and 17C. Hingedly connected along the other edge of the side wall 17 along foldline F6 is a side forming back flap 19.

In accordance with this invention, each of the blanks A and B is provided with complimentary locking means which extend beyond the transverse edge or marginal portion of the respective blanks. As shown, blank A is provided with a marginal flap 20 which is hingedly connected to the outer edge portion of the side wall 13 along a foldline F7. As best seen in FIGS. 1 and 3, the marginal portion 20 has formed therein one or more locking tabs 21. Referring to FIG. 3, the locking tab 21 is die cut out of the plane of the marginal flap 20 so as to define a generally T-shaped tab having a cross head portion 21A and a stem portion 21B. In the illustrated embodiment, the cross head portion 21A of the locking tab is hingedly connected relative to the marginal flap 20 about a foldline F8. It will thus be apparent that the locking tab 21 can be folded out of the plane of flap 20 from which it is formed and foldline F8. The marginal portion 20 in turn is foldable relative to the adjacent side wall about foldline F7.

Connected to the other marginal portion of the blank A, are one or more complimentary locking tabs 22. As best seen in FIGS. 1 and 2, complimentary locking tab 22 projects outwardly beyond the edge of the adjacent end wall 12 so as to define a tab having an enlarged head portion 22A, which is connected to the end wall by a reduced neck portion 22B. Formed in the neck portion 22B of tab 22 is a slot or opening 23. The slot or opening 23 is sized so as to receive the stem portion 21B of locking tab 21 in the assembled position of the box body 10, as will be hereinafter described.

The blank B is also provided with a marginal flap 20 similar to that described with respect to blank A and which flap 20 is hingedly folded about foldline F9. The marginal flap 20 of blank B is also provided with a locking tab 21 blanked out of the plane of flap 20, as hereinbefore described. The other marginal edge of blank B is provided with the complimentary locking tab 22, constructed as hereinbefore described with respect to blank A.

To erect blanks A and B to define a unit body 10 as shown in FIG. 4, the tabs 22 on blank A are inserted into the opening defined in the marginal portions 20 of blank B, formed by the blanking of the complimentary tabs 21 therefrom. As best seen in FIG. 5, the two blanks sections A and B are joined together by folding the marginal flap 20 of one blank, e.g. blank B, normal to its adjacent sidewall 17 and thereafter inserting the enlarged head portion 22A of tab 22, on the other blank A through the opening of the marginal flap 20, defined by the blanked out tab 21 of blank B. As best seen in FIG. 5, the interlocking of the complimentary tabs 21 and 22 secures the adjacent edge portions of the respective blank in a positive manner to one another. This is attained by having the head portion 22A of tab 22 formed with a transverse dimension which is greater than the opening defined by tab 21. The other adjacent ends of the respective blank are also similarly connected by inserting the locking tabs 22 into the opening defined by the complimentary tabs 21, as best seen in FIG. 4. Thus, a generally rectangularly shaped structure is defined by joining the two blanks A and B, as described herein.

Figure 6:
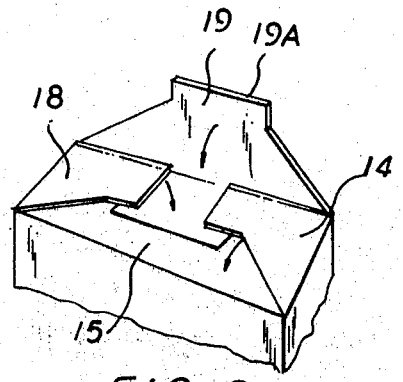
FIG. 6 is a perspective view of the back portion of the body during erection.

The respective back forming flaps 14, 15, 18 and 19 are then folded about their respective foldlines as indicated in FIG. 6 to define the back wall of the unit body 10. As best seen in FIG. 6, the back panels 15 and 19 are folded in a manner so as to underlie and overlie, respectively, the end back flaps 14 and 18, as shown. Back flap 19 is formed with a tongue portion 19A, which is received in the slot defined by the assembled back flaps 14, 15 and 18 so as to maintain the back flaps in the assembled position.

Figure 10:
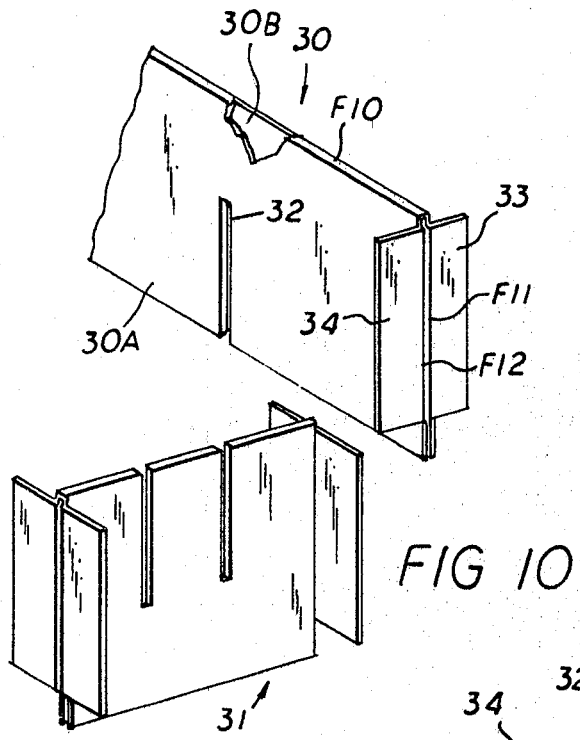
FIG. 10 is an exploded perspective view illustrating the manner in which the partitions are assembled to define the compartments.
Figure 9:
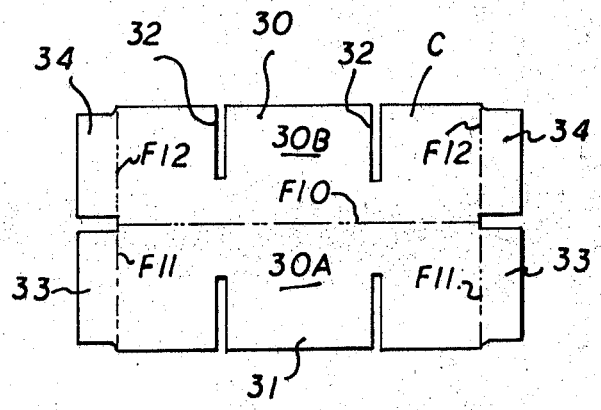
FIG. 9 is a plan view of the blank from which the partitions are formed.

To define a compartmentized storage unit 11, as shown in FIG. 8, a plurality of intersecting partition members 30, 31, are arranged to extend either horizontally or vertically as shown. Referring to FIG. 9, each partition is preferably formed of a single blank of sheet material. The blank C is provided with a longitudinally extending central foldline F10 about which blank C can be reversedly folded as indicated in FIG. 10. The opposed folds 30A and 30B of the blank C are each provided with a plurality of space slots 32 which, in the folded position, are disposed in coincidental relationship for receiving a complimentary slot of a similar partition disposed at 90 degrees with respect thereto, as best seen in FIGS. 8 and 10. The respective folds 30A and 30B of panel C are each provided with transversely extending opposed ear flaps 33, 34, which are hingedly connected about respective foldlines F11 and F12. The arrangement is such that in the folded position of blank C, the ear flaps 33 and 34 are reversely folded, as best seen in FIG. 10. It will be understood that partition 31 is similarly constructed.

To secure the partitions formed of blank C, as described within the unit body 10, the respective partitions are inserted into the body so as to extend either longitudinally and/or transversely thereacross; before the side or end flaps 13A, B, C or 17A, B, C are folded inwardly. The longitudinally extending partitions between the opposed end walls 12 and 16 of the body are secured by disposing the opposed ear flaps 33, 34, contiguous against the adjacent end wall. The end wall flaps 16A, B, C and 12A, B, C are then folded inwardly as best seen in FIG. 7 to secure the ear flaps between end wall and adjacent end wall flaps. It is to be understood that the end wall flaps are sized so that each end wall flap 12A, B and C, and 16A, B and C are frictionally retained in their folded position between the pair of adjacent partitions and/or side wall.

The transversely extending partitions 31 are secured in the assembled position by locating the respective ear flaps thereof contiguous to the opposed side walls of the body and folding the respective side wall flaps inwardly of the body as seen in FIG. 7. The arrangement is such that in the finished unit structure as shown in FIG. 8, a storage unit is formed having a plurality of independent compartments for receiving various types of articles. From the foregoing description, it will be apparent that the entire storage unit 11, which is compartmentized, can be readily erected from pre-scored blanks without the use of any extraneous fastening means.

Figure 11:
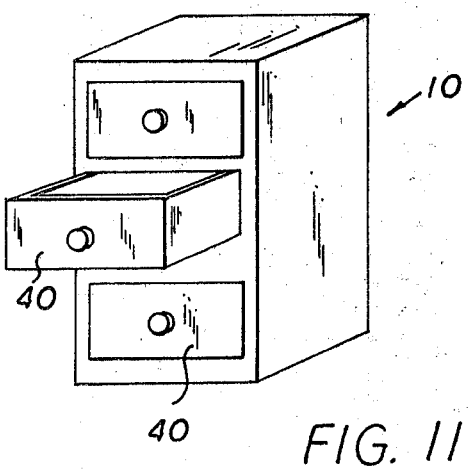
FIG. 11 is a perspective view of a modified embodiment

As shown in FIG. 11, the unit body 10, as described with respect to FIGS. 1 through 4, can also be utilized as a housing for receiving a plurality of sliding drawers 40 for containing the stored articles. In this form of the invention, the partitions extend in one direction only and define the shelf or support on which a drawer 40 may be slidably supported as seen in FIG. 11. Thus, depending upon the number of partitions utilized, the construction described can be readily used to form a compartmentized storage unit as seen in FIG. 8, or can be utilized as a chest of drawers as in FIG. 11, wherein a drawer 40 is slidably supported on each of the respective partitions extending either transversely or longitudinally of the box body.

Figure 12:
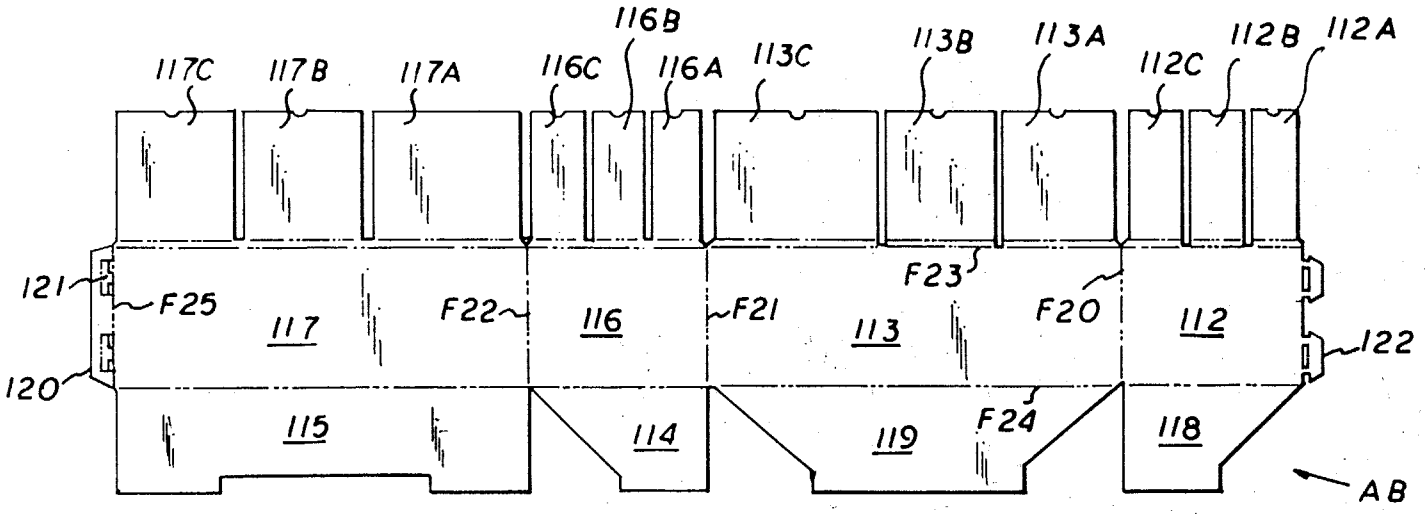
FIG. 12 is a plan view of a modified blank construction.
Figure 13:
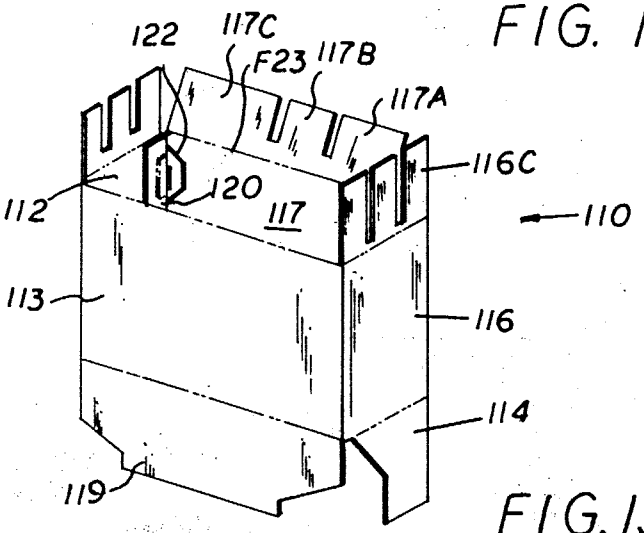
FIG. 13 is a perspective view of the blank construction of FIG. 12 in a partially erected position.

Referring to FIGS. 12 and 13, it will be noted that the body of a storage unit simulating a piece of furniture for home and office use as defined with respect to FIGS. 1 to 11, can be readily fabricated from a single blank of sheet material such as blank AB. Blank AB comprises a unitary sheet of cardboard or corrugated board which is socred and die-cut to define hingedly connected end wall portion 112, side wall portion 113, end wall portion 116, and side wall portion 117. The respective end and side wall portions 112, 113, 116, 117 are hingedly connected about transversely extending foldlines F20, F21, F22. Connected along a marginal portion of blank AB along foldline F23 are a plurality of corresponding end wall flaps 112 A, B, C; 116 A, B, C and side wall flaps 113 A, B, C and 117 A, B, C, whose function and structure is similar to that defined with respect to the side and end wall flaps of FIG. 1. Connected to the other longitudinal marginal portion of blank AB along foldline F24 are the corresponding end back forming flaps 114 and 118 and side back forming flaps 115 and 119 respectively.

In this form of the invention, one marginal end portion of blank AB is provided with a marginal flap 120 hingedly folded about a transverse foldline F25. As described with respect to FIG. 1, flap 120 has formed therein a locking tab 121 which is similar to locking tab 21. The other marginal edge portion of blank AB is formed with one or more complimentary locking tabs 122 similar in construction to that described with respect to tab 22 of FIG. 1. It will be understood that locking tabs 122 correspond in number to the number of complimentary tabs 121 formed in the marginal flap 120.

The erection of the unit body 110 from blank AB is illustrated in FIG. 13. This is readily attained by folding the blank AB about the respective transverse foldlines F20, F21 and F22 to define a rectangular shape body. In doing so, the marginal flap 120 is folded along foldline F25 to overlie an inside portion of the adjacent end wall portion 112. The adjacent free marginal portions of blank AB are secured by the interengagement of the complimentary interlocking tabs 121 and 122 similar to that hereinbefore described in FIG. 1. In the partially erected position as shown in FIG. 13, the body unit thus defined can be completed in the manner hereinbefore described with respect to FIGS. 4 through 11.

From the foregoing, it will be noted that the storage unit simulates a furniture piece such as a chest of drawers, shoe-organizer and the like and that it is readily formed with a body portion which can be easily erected from either one piece wrap around blank or from a pair of generally similarly shaped blanks, where the respective blanks are secured in a positive manner with integrally formed complimentary interlocking tabs located on the free ends of the blanks. With the described construction, the fabrication of the unit body is substantially simplified by the elimination of all gluing operations and the cost of fabrication is proportionately decreased accordingly.

While the invention has been described with respect to particular embodiments thereof, it will be readily appreciated and understood that variations and modifications may be made without departing from the spirit or scope of the invention.

What is claimed is:

1. A knock down storage unit having opposed side and end walls formed of readily foldable cardboard material comprising a pair of blanks formed of sheet material, each of said blanks having opposed transverse edge portions and a transversely extending foldline disposed intermediate said edge portions about which each of said respective blanks can be folded to define a side wall and an adjacent end wall of said unit in the assembled position of said blanks, complementary interlocking means connected to the respective edge portion of said blanks whereby the edge portion of one blank can be secured to the adjacent edge portion of the other blank in the assembled position of said box, said complementary locking means including a marginal flap hingedly connected about a foldline coincident to one edge portion of said blank, a first locking tab blanked out of said marginal flap and defining a slot in said marginal flap, and a second locking tab connected to the other edge portion of said blank, said second locking tab having a slot formed therein whereby said second locking tab engages said slot formed in said marginal flap defined by said first locking tab blanked out of the marginal flap of one blank, and said first locking tab is fitted to the slot of said second locking tab connected to the adjacent edge of the other blank for maintaining the respective blanks locked in their assembled rectilinear shape, wherein said first locking tab blanked out of said marginal flap includes a T shaped tab having a cross-head portion and a stem portion, said cross-head portion being hingedly connected to said marginal portion about said foldline spaced from said one edge of said blank.

2. A knockdown storage unit as defined in claim 1 wherein said second locking tab projects outwardly from said other edge of said blank and hingedly foldable about a foldline coincident to said other edge, and said second locking tab having a transverse slot formed therein adjacent said other edge, said T shaped tab having its stem portion adapted to be inserted through said slot of said second locking tab in the assembled position of said blanks.

3. A knockdown storage unit as defined in claim 2 wherein said second locking tab includes a head portion and a reduced neck portion, said head portion being adapted to be inserted into the opening of said marginal flap defined by blanking of said first locking tab and said neck portion of said second locking tab being hingedly connected to said other edge portion of said blank.

4. A knockdown storage unit as defined in claim 3, wherein said slot in said second tab extends transversely of said neck portion.

5. A knockdown storage unit as defined in claim 4 wherein said head portion of said second locking tab is provided with a transverse width which is greater than the width of said neck portion.

6. A knockdown storage unit as defined in claim 5 wherein each of said blanks include a side back flap and an end back flap hingedly connected about a foldline extending longitudinally along the longitudinal edge of the respective side wall and end wall of said respective blanks whereby said side back and end back flaps in the assembled position form the back wall of said unit.

7. A knockdown storage unit as defined in claim 6 wherein each of said blanks include a plurality of spaced apart side wall flaps hingedly connected about a foldline extending longitudinally along the other longitudinal edge of said respective side walls whereby in the folded position of said blanks, said plurality of side wall flaps are reversely folded to the inside of said box to overlie the adjacent side wall in the assembled position of said box.

8. A knockdown storage unit as defined in claim 7 and including a plurality of partitions extending transversely between said side walls in the assembled position of said box.

9. A knockdown storage unit as defined in claim 8 whereby each of said partitions is defined by a blank having a foldline about which partition blank is reversibly folded and said partition blank having opposed marginal ear flaps hingedly connected and a transverse foldline, said ear flaps in the folded position being oppositely disposed to either side of said partition.

10. A knockdown storage unit as defined in claim 6 wherein each of said blanks include a plurality of end wall flaps hingedly connected to a marginal edge of said end walls, whereby in the folded position of said blanks, said plurality of end wall flaps are folded to the inside of said box so as to overlie the adjacent end wall in the assembled position of said box.

11. A knockdown storage unit as defined in claim 10 and including a plurality of partitions extending longitudinally and transversely of said box so as to divide the interior of said box into a plurality of individual compartments.

12. A knockdown storage unit as defined in claim 8, and including a drawer slidably supported on each of said partitions in the assembled position of said box.

13. A knockdown storage unit comprising a body portion, said body portion including a blank of readily foldable sheet material having a plurality of transversely spaced apart foldlines to define hingedly connected side and end forming wall portions, said blank having opposed free edge portions, a marginal flap hingedly connected about a foldline extending along one free edge portion of said blank, a first locking tab blanked out of the plane of said marginal flap and defining a slot in said marginal flap, a complimentary locking tab integrally formed and projecting beyond the other free edge of said blank, whereby in the erected position of said blank, the complimentary tab and locking tab interlock to maintain said blank in the erected body forming position, said first locking tab includes a T-shaped tab having a cross head portion and a reduced step portion, said cross head portion being hingedly connected to said marginal flap whereby said stem portion is pivoted out of the plane of said marginal portion, said complimentary locking tab having a head portion formed with a width greater than said slot defined by said locking tab in said marginal flap, and said complimentary tab having a traverse slot formed therein for receiving the stem portion of said first locking tab in the interlocking position of said tabs.

* * * * *